US008722602B2

(12) United States Patent
Fujinami et al.

(10) Patent No.: US 8,722,602 B2
(45) Date of Patent: May 13, 2014

(54) GREASE

(75) Inventors: Yukitoshi Fujinami, Chiba (JP); Hitoshi Hata, Chiba (JP); Shinya Nakatani, Kanagawa (JP); Atsushi Yokouchi, Kanagawa (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 423 days.

(21) Appl. No.: 12/447,146

(22) PCT Filed: Oct. 24, 2007

(86) PCT No.: PCT/JP2007/070695

§ 371 (c)(1),
(2), (4) Date: Apr. 24, 2009

(87) PCT Pub. No.: WO2008/050787

PCT Pub. Date: May 2, 2008

(65) Prior Publication Data

US 2010/0029524 A1 Feb. 4, 2010

(30) Foreign Application Priority Data

Oct. 25, 2006 (JP) ..... 2006-290248

(51) Int. Cl.
*C10M 169/02* (2006.01)

(52) U.S. Cl.
CPC ..... *C10M 169/02* (2013.01); *C10M 2215/1026* (2013.01); *C10M 2207/2835* (2013.01); *C10M 2215/064* (2013.01); *C10M 2207/289* (2013.01); *C10M 2207/126* (2013.01); *C10M 2223/041* (2013.01); *C10M 2223/047* (2013.01); *C10N 2210/02* (2013.01); *C10N 2230/08* (2013.01); *C10N 2250/10* (2013.01)
USPC ..... 508/528; 508/506

(58) Field of Classification Search
USPC ..... 508/506, 528
See application file for complete search history.

(56) References Cited

U.S. PATENT DOCUMENTS

| | | | | |
|---|---|---|---|---|
| 5,080,642 | A * | 1/1992 | Takami | 475/263 |
| 5,854,183 | A * | 12/1998 | Hasegawa et al. | 508/316 |
| 6,919,301 | B2 * | 7/2005 | Nakatani et al. | 508/391 |
| 2002/0137639 | A1 | 9/2002 | Asao et al. | |
| 2008/0026963 | A1 * | 1/2008 | Sakamoto et al. | 508/218 |

FOREIGN PATENT DOCUMENTS

| | | | |
|---|---|---|---|
| EP | 1 327 625 | A1 | 7/2003 |
| JP | 09 100481 | | 4/1997 |
| JP | 11 82688 | | 3/1999 |
| JP | 2000 234638 | | 8/2000 |
| JP | 2002 221231 | | 8/2002 |
| JP | 2003 306687 | | 10/2003 |
| JP | 2006 132619 | | 5/2006 |
| JP | 2006 161827 | | 6/2006 |
| JP | 2006 162032 | | 6/2006 |
| JP | 2007 138079 | | 6/2007 |
| WO | WO 2006109541 | A1 * | 10/2006 |

OTHER PUBLICATIONS

U.S. Appl. No. 12/444,472, filed Apr. 6, 2009, Fujinami, et al.
Extended European Search Report issued Jun. 27, 2011, in Patent Application No. 07830429.2.

* cited by examiner

*Primary Examiner* — James Goloboy
(74) *Attorney, Agent, or Firm* — Oblon, Spivak, McClelland, Maier & Neustadt, L.L.P.

(57) ABSTRACT

Grease which includes a base oil containing at least 50% by mass of a specific diester compound of a glycol with a branched carboxylic acid, and a specific diurea compound as a thickener. The grease is excellent in low-temperature performance and has low oil separation tendency. In particular, when used in a rotation transmission device having a built-in one-way clutch, the grease can provide satisfactory clutch engagement performance (intermeshing) at low temperatures and is less apt to cause oil separation under high centrifugal force.

9 Claims, No Drawings

GREASE

This application is a 371 of PCT/JP07/70695, filed Oct. 24, 2007.

TECHNICAL FIELD

The present invention relates to grease and, more specifically, to grease which excels in low-temperature performance, which has low oil separation tendency and which is particularly suited for use in a rotational transmission device having a built-in one-way clutch.

BACKGROUND ART

In recent years, for the transmission of a driving force alone in a specific direction, a rotation transmission device with a built-in one-way clutch has been used in automobile auxiliary machines such as an alternator, auxiliary machine driving devices and crankshafts of engines. The rotation transmission device with a built-in one-way clutch is an apparatus which includes an inner-diameter-side member, a cylindrical-shaped outer-diameter-side member located around the inner-diameter-side member concentrically with the inner-diameter-side member, rolling bearings located between the outer peripheral surface of the inner-diameter-side member and the inner peripheral surface of the outer-diameter-side member for supporting the inner-diameter-side member and the outer-diameter-side member while permitting relative rotation between the inner-diameter-side member and the outer-diameter-side member, and a one-way clutch adapted for transmitting only such a rotational power that rotates one of the outer-diameter-side member and the inner-diameter-side member relative to the other in a specified direction.

Such an alternator and the like now progress in performance and output and are used in a wide area including cold climate areas. As a consequence, the conditions under which the rotation transmission device with a built-in one-way clutch is used become severe. Namely, the rotation transmission device is required to operate at a higher revolution speed and a higher load and to achieve a desired performance under an extremely low temperature so as to withstand use in cold climate areas. In this circumstance, grease used in such a rotation transmission device with a built-in one-way clutch operated under severe conditions is desired to produce a high performance and to satisfy the following characteristics.

(i) The grease must provide satisfactory clutch engagement performance (intermeshing) at low temperatures. When an engine is started in an extremely cold area in winter, satisfactory clutch engagement performance (intermeshing) is demanded in order for an alternator or the like device to achieve smooth operation.

(ii) The grease must be less apt to cause oil separation under high centrifugal force. Since auxiliary parts of automobiles such as alternator are operated at high revolution speed and used under high centrifugal force, the grease must be less apt to cause oil separation.

It is known that the grease performance at low temperatures may be improved by using a low viscosity base oil. Grease using a low viscosity base oil, however, generally causes oil separation, with the oil separation tendency increasing under high centrifugal force conditions. When, on the other hand, a high viscosity base oil is used, the grease performance at low temperatures is deteriorated though the oil separation tendency is reduced.

Namely, the good clutch engagement performance at low temperatures as described in (i) above and the reduction of oil separation under a high centrifugal force as described in (ii) above are generally opposing properties. It is, therefore, not easy to improve these properties at the same time.

As conventional greases for use in such a rotation transmission device with a built-in one-way clutch, there are disclosed grease in which an ether-based base oil such as an alkyl diphenyl ether is used (see, for example, Patent Documents 1 and 2), grease in which a base oil containing a polyol ester having a kinematic viscosity at 40° C. of 20 $mm^2/S$ or less is used (see, for example, Patent Document 3), grease in which a base oil such as a mineral oil, a poly-α-olefin oil or a polyol ester oil is used together with a thickener containing a diurea compound (see, for example, Patent Document 4), and grease in which a urea thickener is compounded into an ester-based or synthetic oil-based base oil having a pressure viscosity coefficient of 12 $Pa_{-1}$ or more (see, for example, Patent Document 5).

The grease using an alkyl diphenyl ether as a base oil is not satisfactory with respect to low temperature properties, i.e. clutch engagement performance at low temperatures. The grease using a base oil containing a polyol ester is generally not fully satisfactory with respect to clutch engagement performance at low temperatures. The other base oils such as a poly-α-olefin oil have similar problems. Accordingly, there is a room for further improving the grease for use in a rotational transmission device having a built-in one-way clutch.

[Patent Document 1] Japanese Patent Application Publication No. 2006-162032

[Patent Document 2] Japanese Patent Application Publication No. H11-82688

[Patent Document 3] Japanese Patent Application Publication No. 2006-161827

[Patent Document 4] Japanese Patent Application Publication No. 2006-132619

[Patent Document 5] Japanese Patent Application Publication No. 2000-234638

DISCLOSURE OF THE INVENTION

Problem to be Solved by the Invention

Under the above-mentioned circumstance, the present invention has as its object the provision of grease which excels in low-temperature performance, which has reduced oil separation and which, particularly when used in a rotation transmission device having a built-in one-way clutch, can provide satisfactory clutch engagement performance (intermeshing) at low temperatures and is less apt to cause oil separation under high centrifugal force.

Means for Solving the Problem

The present inventors have made an earnest study with a view toward developing grease having the above desirable properties and, as a result, have found that the above-described problems can be solved by using grease containing, as a base oil, a dicarboxylic acid diester of a glycol having a specific structure, and, as a thickener, a diurea compound having a specific structure. The present invention has been completed based on the above finding.

That is, the present invention provides the followings:

[1] Grease comprising a base oil containing at least 50% by mass of a diester compound of a glycol with a branched carboxylic acid represented by the general formula (1):

[Chemical Formula 1]

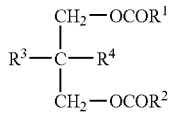

(1)

[wherein $R^1$ and $R^2$ each independently represent a $C_3$ to $C_{20}$ branched alkyl group and $R^3$ and $R^4$ each independently represent a $C_1$ to $C_6$ alkyl group], and, as a thickener, a diurea compound represented by the general formula (2):

$$R^6—NHCONH—R^5—NHCONH—R^7 \quad (2)$$

[wherein $R^6$ and $R^7$ each independently represent (X) a $C_6$ to $C_{24}$ monovalent chain hydrocarbon group, (Y) a $C_6$ to $C_{12}$ monovalent alicyclic hydrocarbon group or (Z) a $C_6$ to $C_{12}$ monovalent aromatic hydrocarbon group, and $R^5$ represents a $C_6$ to $C_{15}$ divalent aromatic hydrocarbon group, and wherein x, y and z content (mole %) of the groups X, Y and Z, respectively, in the groups $R^6$ and $R^7$ satisfy the following formulas (a) and (b):

$$(x+y)/(x+y+z) \geq 0.90 \quad (a)$$

$$x/y = 50/50 \text{ to } 0/100 \quad (b)];$$

[2] The grease as defined in above [1], wherein $R^1$ and $R^2$ each independently represent a $C_3$ to $C_{12}$ branched alkyl group;

[3] The grease as defined in above [1] or [2], wherein $R^1$ and $R^2$ each independently represent a $C_6$ to $C_{10}$ branched alkyl group;

[4] The grease as defined in any one of above [1] to [3], wherein $R^1$ and $R^2$ each independently represent a $C_8$ or $C_9$ branched alkyl group;

[5] The grease as defined in any one of above [1] to [4], wherein the diester compound of a glycol with a branched carboxylic acid has a flash point of 170° C. or more;

[6] The grease as defined in any one of above [1] to [5], wherein the diester compound of a glycol with a branched carboxylic acid has a pour point of −50° C. or less;

[7] The grease as defined in any one of above [1] to [6], further comprising a viscosity increasing agent;

[8] The grease as defined in any one of above [1] to [7], further comprising at least one additive selected from a lubricity improver, an antioxidant and a rust preventing agent;

[9] The grease as defined in any one of above [1] to [8], wherein an oil component of the grease has a kinematic viscosity at 40° C. of 15 to 150 $mm^2/S$, said oil component being a component remaining after removing the thickener from the grease; and

[10] The grease as defined in any one of above [1] to [9], wherein the grease is used in a rotation transmission device having a built-in one-way clutch.

Effect of the Invention

According to the present invention, there can be provided grease, which excels in low-temperature performance, which has low oil separation tendency and which, particularly when used in a rotation transmission device having a built-in one-way clutch, can provide satisfactory clutch engagement performance (intermeshing) at low temperatures and is less apt to cause oil separation under high centrifugal force.

BEST MODE FOR CARRYING OUT THE INVENTION

Grease of the present invention contains, as a base oil, a diester compound of a glycol with a branched carboxylic acid represented by the general formula (1):

[Chemical Formula 2]

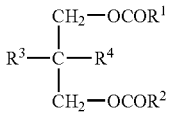

(1)

wherein $R^1$ and $R^2$ each independently represent a $C_3$ to $C_{20}$ branched alkyl group and $R^3$ and $R^4$ each independently represent a $C_1$ to $C_6$ alkyl group.

In the general formula (1), $R^1$ and $R^2$ each independently represent a $C_3$ to $C_{20}$ branched alkyl group. Typical examples of the branched alkyl group represented by $R^1$ and $R^2$ include an isopropyl group, an isobutyl group, an isopentyl group, a 1-ethylpentyl group, an isohexyl group, a 2-ethylhexyl group, an isooctyl group, a 2,4,4-trimethylpentyl group, an isononyl group, an isodecyl group, an isoundecyl group, an isododecyl group, an isotridecyl group, an isotetradecyl group, an isopentadecyl group, an isohexadecyl group, an isoheptadecyl group, an isooctadecyl group, an isoeicosyl group and other branched alkyl groups.

Each of the groups $R^1$ and $R^2$ may be one selected from the branched alkyl groups or may be a mixture of two or more thereof. The groups $R^1$ and $R^2$ are independent from each other and may be different branched alkyl groups.

Among the above alkyl groups, $R^1$ and $R^2$ are preferably a $C_3$ to $C_{12}$ branched alkyl group, and each of $R^1$ and $R^2$ is preferably a $C_3$ to $C_{12}$ branched alkyl group, for reasons of significantly improved clutch engagement performance. The branched alkyl group is more preferably a $C_6$ to $C_{10}$ branched alkyl group, particularly preferably a $C_8$ or $C_9$ branched alkyl group such as a 2,4,4-trimethylpentyl group, an isooctyl group or an isononyl group.

In the general formula (1), $R^3$ and $R^4$ each independently represent a $C_1$ to $C_6$ alkyl group. Typical examples of the alkyl group represented by $R^3$ and $R^4$ include a methyl group, an ethyl group, an n-propyl group, an isopropyl group, an isobutyl group, an isopentyl group, an isohexyl group and other alkyl groups.

The $R^3$ and $R^4$ groups may be one selected from the above alkyl groups or may be a mixture of two or more groups. The groups $R^3$ and $R^4$ are independent from each other and may be different alkyl groups.

Among the above alkyl groups, $R^3$ and $R^4$ are preferably a $C_1$ to $C_3$ alkyl group, more preferably each of $R^3$ and $R^4$ is a methyl group, for reasons of performance and production.

In the present invention, it is preferred that the diester compound of a glycol with a branched carboxylic acid represented by the general formula (1) have the following properties, i.e. a flash point of 170° C. or more (more preferably 185° C. or more), a kinematic viscosity at 40° C. of 8 to 30 $mm^2/s$, a viscosity index of 30 or more (more preferably 70 or more) and a pour point of −45° C. or less (more preferably −50° C. or less).

The diester compound of a glycol with a branched carboxylic acid represented by the general formula (1) used in the present invention may be produced for example by the following method.

Namely, a $C_4$ to $C_{21}$ branched aliphatic monocarboxylic acid (A), preferably a $C_4$ to $C_{13}$ branched aliphatic monocarboxylic acid, and a glycol (B) are subjected to esterification in the presence or absence of a catalyst and the obtained esterified product is subsequently washed with an alkali, etc.

In this case, the $C_4$ to $C_{21}$ branched aliphatic monocarboxylic acid of the component (A) is a carboxylic acid corresponding to $R^1$ and $R^2$ in the general formula (1).

Specific examples of the monocarboxylic acid include 3,5,5-trimethylhexanoic acid, isononanoic acid, isodecanoic acid, 3,5,5,7,7-pentamethyloctanoic acid. Among these, 3,5,5-trimethylhexanoic acid and isodecanoic acid are particularly preferred.

As the glycol of the component (B), a glycol corresponding to the residue of the compound of the general formula (1) from which the acyl groups ($R^1CO$ and $R^2CO$) have been removed.

Specific examples of the glycol include neopentyl glycol, 2,2-dimethyl-1,3-propanediol and 2-butyl-2-ethyl-1,3-propanediol. Among these, neopentyl glycol is particularly preferred.

In the esterification, the component (A) (carboxylic acid component) is preferably used in an amount of 2.01 to 2.10 moles, more preferably 2.01 to 2.05 moles, per mole of the component (B) (glycol component).

As the esterification catalyst, there may be mentioned Lewis acids, alkali or alkaline earth metal compounds and sulfonic acids. Specific examples of the Lewis acid include aluminum derivatives, boron derivatives, tin derivatives and titanium derivatives. Specific examples of the alkali or alkaline earth metal compound include sodium alkoxides, potassium alkoxides and barium alkoxides. Specific examples of the sulfonic acid include p-toluenesulfonic acid, methanesulfonic acid and sulfuric acid.

The amount of the catalyst is generally about 0.1 to 1.0% by mass based on a total amount of the carboxylic acid component and the glycol component used as the raw materials.

The grease according to the present invention uses a base oil containing at least 50% by mass of the diester compound of a glycol with a branched carboxylic acid represented by the general formula (1). The content of the diester compound is preferably at least 70% by mass, more preferably at least 80% by mass. When the content of the diester compound is 50% by mass or more, the object of the present invention may be fully achieved.

The grease of the present invention may contain, in addition to the diester compound of a glycol with a branched carboxylic acid represented by the general formula (1), other base oil in an amount of preferably 50% by mass or less, more preferably 30% by mass or less, particularly preferably 20% by mass or less.

As the "other base oil", there may be mentioned, for example, alicyclic hydrocarbon compounds, mineral oils and various synthetic oils.

Examples of the alicyclic hydrocarbon compounds include alkane derivatives having two or more cyclohexane rings, such as 2,4-dicyclohexyl-2-methylpentane and 2,4-dicyclohexylpentane; alkane derivatives having one or more decalin rings and one or more cyclohexyl rings, such as 1-cyclohexyl-1-decalylethane; and alicyclic compounds having two or more bicyclo[2.2.1]heptane rings, bicyclo[3.2.1]octane rings, bicyclo[2.2.2]octane rings and/or bicyclo[3.3.0]octane rings, such as endo-2-methyl-exo-3-methyl-exo-2-[(exo-3-methylbicyclo[2.2.1]hepto-exo-2-yl)methyl]-bicyclo[2.2.1]heptane.

Examples of the mineral oil include paraffinic mineral oils and naphthenic mineral oil. Examples of the synthetic oils include poly-α-olefins such as 1-decene oligomers, polybutene, alkyl benzenes, alkyl naphthalenes and polyalkylene glycols.

In the present invention, the base oil may contain a viscosity increasing agent. The viscosity increasing agent is used, if necessary, to increase the viscosity of the base oil and to adjust the kinematic viscosity thereof to a proper value.

Specific examples of the viscosity increasing agent include polybutene, polyisobutylene, polymethacrylate (PMA), an olefin copolymer (OCP), polyalkylstyrene (PAS) and a styrene-diene copolymer (SCP). It is particularly preferable to use at least one of a member selected from polybutene, polyisobutylene, a styrene-isoprene copolymer, an ethylene-α-olefin copolymer (all of which have a number average molecular weight of 800 to 10,000, more preferably 1,000 to 5,000) and polymethacrylate which has a weight average molecular weight of 10,000 to 1,000,000, preferably 100,000 to 800,000. The compounding amount of the viscosity increasing agent is generally about 0.01 to 20% by mass, in terms of the amount of resin, based on the weight of the composition. The compounding amount is suitably selected so that the viscosity of an oil component of the grease (which will be described hereinbelow) has a desired viscosity value.

It is preferred that a kinematic viscosity at 40° C. of an oil component of the grease be adjusted.

The term "oil component" as used herein is intended to refer to a component remaining after removing a thickener from the grease. More specifically, the oil component is a mixture of the above-described base oil, the above-described viscosity increasing agent and various additives which will be described hereinafter. Namely, when neither the viscosity increasing agent nor additives are compounded, the oil component is the base oil only. When the base oil and viscosity increasing agent are used without compounding additives, then a mixture of the base oil and viscosity increasing agent is the oil component. When the base oil is used together with the viscosity increasing agent and additives, a mixture of them is the oil component.

The oil component may be obtained as a separated matter by centrifuging the grease.

It is preferred that the oil component of the grease of the present invention have a kinematic viscosity at 40° C. of 15 to 150 $mm^2/s$, more preferably 20 to 150 $mm^2/s$, still more preferably 20 to 90 $mm^2/s$, particularly preferably 30 to 60 $mm^2/s$. When the kinematic viscosity at 40° C. of the oil component is 15 $mm^2/s$ or more, oil separation of the grease may be suppressed. When the kinematic viscosity at 40° C. of the oil component is 150 $mm^2/s$ or less, the properties of the grease at low temperatures may be maintained in good conditions.

The grease of the present invention is obtained by compounding, as a thickener, a diurea compound represented by the general formula (2) shown below into a base oil containing at least 50% by mass of the diester compound of a glycol with a branched carboxylic acid represented by the general formula (1):

$$R^6NHCONHR^5NHCONHR^7 \quad (2)$$

[wherein $R^6$ and $R^7$ each independently represent (X) a $C_6$ to $C_{24}$ monovalent chain hydrocarbon group, (Y) a $C_6$ to $C_{12}$ monovalent alicyclic hydrocarbon group or (Z) a $C_6$ to $C_{12}$ monovalent aromatic hydrocarbon group, and $R^5$ represents a $C_6$ to $C_{15}$ divalent aromatic hydrocarbon group and wherein contents (mole %) x, y and z of the groups X, Y and Z, respectively, in the groups $R^6$ and $R^7$ satisfy the following formulas (a) and (b):

$$(x+y)/(x+y+z) \geq 0.90 \quad (a)$$

$$x/y = 50/50 \text{ to } 0/100 \quad (b)].$$

As the divalent $C_6$ to $C_{15}$ aromatic hydrocarbon group represented by $R^5$ of the above general formula (2), there may be mentioned a phenylene group, a diphenylmethanediyl group and a tolylene group.

The monovalent $C_6$ to $C_{24}$ chain hydrocarbon group represented by $R^6$ and $R^7$ of the above general formula (2) may be a straight chained or branched, saturated or unsaturated chain hydrocarbon group. Thus, as the monovalent $C_6$ to $C_{24}$ chain hydrocarbon group, there may be mentioned straight chained and branched chained hydrocarbon groups such as various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various octadecenyl groups, various nonadecyl groups, and various eicosyl groups. Among these hydrocarbons, $C_{13}$ to $C_{20}$ straight chained or branched, saturated or unsaturated hydrocarbon groups are preferred. Particularly preferred are $C_{16}$ to $C_{18}$ chain hydrocarbon groups such as various hexadecyl groups, various heptadecyl groups, various octadecyl groups and various octadecenyl groups.

The monovalent $C_6$ to $C_{12}$ alicyclichydrocarbon group represented by $R^6$ and $R^7$ of the above general formula (2) is preferably a saturated alicyclic hydrocarbon group such as a cyclohexyl group or a $C_7$ to $C_{12}$ alkyl-substituted cyclohexyl group. Thus, the monovalent $C_6$ to $C_{12}$ alicyclic hydrocarbon group may be, for example, a cyclohexyl group, a methylcyclohexyl group, a dimethylcyclohexyl group, an ethylcyclohexyl group, a diethylcyclohexyl group, a propylcyclohexyl group, an isopropylcyclohexyl group, a 1-methyl-propyl-cyclohexyl group, a butylcyclohexyl group, an amylcyclohexyl group, an amyl-methylcylohexyl group or a hexylcyclohexyl group. Above all, a cyclohexyl group, a methylcyclohexyl group and an ethylcyclohexyl group are preferred for reasons of production.

The monovalent $C_6$ to $C_{12}$ aromatic hydrocarbon group represented by $R^6$ and $R^7$ of the above general formula (2) may be, for example, a phenyl group, a toluoyl group, a benzyl group, an ethylphenyl group, a methylbenzyl group, a xylyl group, a propylphenyl group, a cumenyl group, an ethylbenzyl group, a methylphenethyl group, a butylphenyl group, a propylbenzyl group, an ethylphenethyl group, a pentylphenyl group, a butylbenzyl group, a propylphenethyl group, a hexylphenyl group, a pentylbenzyl group and a butylphenethyl group.

In the present invention, the proportion of the hydrocarbon groups of $R^6$ and $R^7$ of the general formula (2) that constitute the terminal groups of the diurea compound, namely the composition (mixing ratio) of the raw material amines (mixed amines) from which the $R^6$ and $R^7$ are derived, must satisfy the following formulas (a) and (b):

$$(x+y)/(x+y+z) \geq 0.90 \quad \text{(a)}$$

$$x/y = 50/50 \text{ to } 0/100 \quad \text{(b)}$$

wherein x is a content (mole %) of the chain hydrocarbon groups, y is a content (mole %) of the alicyclic hydrocarbon groups and z is a content (mole %) of the aromatic hydrocarbon groups in the groups $R^6$ and $R^7$.

When the above conditions (a) and (b) are met, tendency of oil separation, particularly oil separation under high centrifugal conditions may be further suppressed.

The value of (x+y)/(x+y+z) in the formula (a) is more preferably 0.95 or more, particularly preferably 0.98 or more. The value of x/y in the formula (b) is more preferably 30/70 to 5/95, particularly preferably 25/75 to 15/85.

The diurea compound may be generally obtained by reaction of a diisocyanate with a monoamine. The diisocyanate may be, for example, diphenylene diisocyanate, diphenylmethane diisocyanate, or tolylene diisocyanate. For reasons of harmlessness, diphenylmethane diisocyanate is preferred. The monoamine may be a $C_{16}$ to $C_{18}$ chain hydrocarbon amine such as hexadecylamine, heptadecylamine, octadecylamine and octadecenylamine, or an alicyclic hydrocarbon such as cyclohexylamine.

The amount of the above-described thickener in the grease is not specifically restricted as long as the grease characteristics may be obtained but is preferably 10 to 30% by mass, more preferably 10 to 20% by mass, based on the grease.

The thickener used in the grease of the present invention serves to impart a consistency thereto. When the amount of the thickener is excessively small, a desired consistency is not obtainable. When the compounding amount is excessively large, the lubricity of the grease is reduced.

The grease according to the present invention may optionally contain an additive or additives such as a lubricity improver, a detergent-dispersant, an antioxidant, an anti-corrosive agent, a rust preventing agent and an antifoaming agent as long as the object of the present invention is not adversely affected.

As the lubricity improver, there may be mentioned, for example, sulfur compounds (sulfurized fats and oils, sulfurized olefins, polysulfides, sulfurized mineral oils, thiophosphates, thiocarbamic acids, thioterpenes, dialkylthiodipropionates, etc.), phosphoric acid esters and phosphorous acid esters (tricresyl phosphate, triphenylphosphite, etc.). As the detergent-dispersant, there may be mentioned, for example, succinimide and boron-containing succinimide.

As the antioxidant, there may be used an amine type antioxidant, a phenol type antioxidant or a sulfur type antioxidant. Among these, an amine type antioxidant is preferred. Examples of the amine type antioxidant include monoalkyldiphenylamine-based compounds such as monooctyldiphenylamine and monononyldiphenylamine; dialkyldiphenylamine-based compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine-based compounds such as tetradibutyldiphenylamine, tetrahexyldiphenylamine, tetraoctyldiphenylamine and tetranonyldiphenylamine; and naphthylamine-based compounds such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine.

As the anti-corrosive agent, there may be mentioned, for example, benzotriazole-type and thiazole type corrosion inhibitors. As the rust preventing agent, there may be mentioned, for example, metal carboxylate type, metal sulfonate type and succinic ester type rust preventing agents. As the antifoaming agent, there may be mentioned silicone type and fluorinated silicone type antifoaming agents.

The compounding amount of the additives may be adequately determined according to the objects of their use. In general, a total amount of these additives is 30% by mass or less based on the lubricant.

A method for preparing the grease according to the present invention is not specifically limited. Generally, the following method may be used.

First, a base oil is added with a predetermined proportion of a thickener and, if desired, with a viscosity increasing agent.

The mixture is heated to a predetermined temperature to obtain a homogeneous mixture.

This is then cooled. When a predetermined temperature is reached, various additives, if desired, are added in predetermined amounts, thereby obtaining grease of the present invention.

EXAMPLES

The present invention will be next described in more detail by way of examples. It should be noted that the present invention is not limited to these examples in any way.

The various properties were determined by the following methods.

(1) Kinematic Viscosity at 40° C. of Base Oil and Oil Component

The kinematic viscosity was measured in accordance with JIS K2283.

(2) Worked Penetration of Grease

The consistency was measured in accordance with JIS K2220.7.5.

(3) Low Temperature Property: Clutch Engagement Performance (Intermeshing) Test

Grease was filled in a clutch pulley unit (actual machine) disclosed in FIG. 1 of Japanese Patent Application Publication No. 2006-64136. An outer wheel was rotated in a locked state. The angular acceleration (limit angular speed: rad/sec$^2$) of the outer wheel beyond which an inner wheel failed to follow was measured. The higher the value, the better is the clutch engagement performance (intermeshing).

(4) Oil Separation Under High Centrifugal Force

An ultracentrifuge "Himac CP70G" manufactured by Hitachi Koki Co., Ltd. was used. A grease composition was filled in a vessel and a portion filled with the grease composition was subjected to centrifugal acceleration of 1.8×105 m$^2$/s (20,000 G) at 40° C. for 5 hours. An amount of an oil component separated from the grease composition was determined as an amount of oil separation.

The base oils used were as follows.

Base Oil-1:

Diester of neopentyl glycol with 3,5,5-trimethylhexanoic acid obtained as described in the following Preparation Example.

Preparation Example

In a 1 L four-necked flask equipped with a stirrer, a nitrogen gas feed pipe, a thermometer and a water separator fitted with a condenser, 483.5 g (3.06 moles) of 3,5,5-trimethylhexanoic acid, 156.3 g (1.5 moles) of neopentyl glycol, xylene (5% by mass based on a total amount of the carboxylic acid and glycol) and tin oxide (0.2% by mass based on a total amount of the carboxylic acid and glycol) as a catalyst were charged. The mixture was heated under a nitrogen stream to 230° C.

Then, the esterification was carried out under a reduced pressure for about 8 hours while removing distilled water by the water separator, as the tentative completion of the reaction is theoretical volume of water (72 g).

After completion of the reaction, excess carboxylic acid was removed by distillation.

The obtained mixture was neutralized with an aqueous sodium hydroxide solution in an excess amount relative to the acid value after the completion of the reaction and then washed with water until the washing water became neutral, thereby obtaining a crude esterification product. The crude esterification product was treated with activated carbon, followed by filtration to obtain 516 g of a diester of neopentyl glycol with 3,5,5-trimethylhexanoic acid having a kinematic viscosity at 40° C. of 13 mm$^2$/s, a flash point of 200° C. and a pour point of −50° C. or less.

Base Oil-2:

An alkylbenzene having a kinematic viscosity at 40° C. of 56 mm$^2$/s, a flash point of 192° C. and a pour point of −37.5° C. was used.

Base Oil-3:

Diisononyl phthalate obtained by esterification of phthalic anhydride with 3,5,5-trimethylhexyl alcohol (isononyl alcohol) in the conventional manner was used. The diisononyl phthalate has a kinematic viscosity at 40° C. of 28 mm$^2$/S, a flash point of 236° C. and a pour point of −50° C.

Example 1

Grease having the compounding composition shown in Table 1 was prepared using the base oil-1 and urea thickener by the following method.

Diphenylmethane-4,4'-diisocyanate in the whole amount to be used was dissolved with heating in two thirds of the total amount to be used of the base oil-1 (including a viscosity increasing agent). In the remainder of the base oil-1, mixed amines (a mixture of n-octadecylamine and cyclohexylamine with 20:80 molar ratio) in an amount of two times the mole of the diphenylmethane-4,4'-diisocyanate were dissolved with heating.

The base oil-1 containing the diphenylmethane-4,4'-diisocyanate was filled in a grease production vessel, to which the base oil-1 containing the mixed amines was gradually added with heating while vigorously stirring at 50 to 60° C. After a temperature of 160° C. was reached, the grease was maintained at that temperature for 1 hour. The compounding amount of the urea thickener was 17% by mass based on a total amount of the grease.

The resulting mixture was cooled to 80° C. at a rate of 50° C./hr and blended with an antioxidant, a lubricity improver and a rust preventing agent. The resulting mixture was allowed to spontaneously cool to room temperature and then subjected to a finish treatment using a three-roll device to obtain grease.

The thus obtained grease was measured for the worked penetration and subjected to the clutch engagement property test (at −30° C., −20° C., 0° C. and 80° C.) and the oil separation test under high centrifugal force. The results are summarized in Table 1.

Example 2

Grease of Example 2 was prepared in the same manner as that in Example 1 except that neither the viscosity increasing agent nor the lubricity improver was used and that the compounding amount of the urea thickener was changed as shown in Table 1. The thus obtained grease was measured for the worked penetration and subjected to the clutch engagement property test (at −30° C., −20° C., 0° C. and 80° C.) and the oil separation test under high centrifugal force. The results are summarized in Table 1.

Comparative Examples 1 and 2

Greases of Comparative Examples 1 and 2 having the compositions shown in Table 1 were prepared in the manner described in Example 1 using the base oil and the urea thickener as shown in Table 1.

Each of the thus obtained greases was measured for the worked penetration and subjected to the clutch engagement property test (at −30° C., −20° C., 0° C. and 80° C.) and the oil separation test under high centrifugal force. The results are summarized in Table 1.

Comparative Examples 3 to 5

Commercial products A, B and C was measured for the worked penetration and subjected to the clutch engagement property test (at −30° C., −20° C., 0° C. and 80° C.) and the oil separation test under high centrifugal force. The results are summarized in Table 1.

The commercial product A is a commercially available urea-based grease containing an alkyl-substituted diphenyl ether as a base oil, the commercial product B is a commercially available urea-based grease containing a pentaerythritol ester as a base oil, and the commercial product C is a commercially available urea-based grease containing a poly-α-olefin as a base oil.

TABLE 1

| | | | Example | | Comparative Example | | | | |
|---|---|---|---|---|---|---|---|---|---|
| | | | 1 | 2 | 1 | 2 | 3 | 4 | 5 |
| Composition (% by mass) | Base oil | Base oil 1 | balance | balance | — | — | Commercial product A | Commercial product B | Commercial product C |
| | | Base oil 2 | — | — | balance | — | | | |
| | | Base oil 3 | — | — | — | balance | | | |
| | Viscosity increasing agent[1)] | | 2 | — | — | — | | | |
| | Urea thickener[2)] | | 17 | 14 | 10.7 | 17.9 | | | |
| | Antioxidant[3)] | | 5.0 | 5.0 | 5.0 | 5.0 | | | |
| | Lubricity improver[4)] | | 2 | — | — | — | | | |
| | Rust preventing agent[5)] | | 0.5 | 0.5 | 0.5 | 0.5 | | | |
| Kinematic viscosity at 40° C. of oil component (component remaining after removing thickener from the grease) ($mm^2/s$) | | | 27.7 | 14.6 | 56.7 | 28.6 | 103 | 33 | 96 |
| Evaluation results | Worked penetration | | 289 | 277 | 231 | 227 | 286 | 264 | 230 |
| | Clutch engagement property test (limit angular speed $rad/sec^2$) | −30° C. | 60000< | 60000< | 30000 | 47000 | 34000 | 30000 | 19000 |
| | | −20° C. | 60000< | 60000< | 60000< | 60000< | — | — | 30000 |
| | | 0° C. | 60000< | 60000< | 60000< | 60000< | 50000 | 60000< | 60000< |
| | | 80° C. | 60000< | 60000< | 60000< | 60000< | 60000< | 60000< | 60000< |
| | Oil separation at high centrifugal force (% by mass) | | 8.8 | 20.5 | 2.3 | 2.5 | 7.1 | 7.2 | 5.6 |

Remarks:

[1)]Viscosity increasing agent: polymethacrylate having a weight average molecular weight of 450,000

[2)]Urea thickener: product obtained by reacting diphenylmethane-4,4'-diisocyanate with a two-fold molar amount of mixed amines (a mixture of n-octadecylamine and cyclohexylamine), $[(x + y)/(x + y + z)] = 1.00$, $x/y = 20/80$

[3)]Antioxidant: a mixture of octylphenyl-1-naphthylamine (2 parts by weight), p,p'-dioctyldiphenylamine (2 parts by weight) and octadecyl-3-(3,5-di-tert-butyl-4-hydroxyphenyl)propionate (1 part by eight)

[4)]Lubricity improver: triphenylphosphorothioate

[5)]Rust preventing agent: zinc stearate

From the results shown in Table 1, it is appreciated that the greases of the present invention (Examples 1 and 2) are excellent in clutch engagement property throughout the temperature range of −30 to 80° C., particularly at low temperatures. Further, the greases of the present invention have relatively minor oil separation under high centrifugal force in spite of the fact that the kinematic viscosity of the oil component is low. The oil separation does not considerably increase. In contrast, the grease of Comparative Example 1 in which an alkylbenzene is used as a base oil, the grease of Comparative Example 2 in which a dialkylester of phthalic acid is used as a base oil and greases of Comparative Examples 3 to 5 which are commercial products, are all unsatisfactory with respect to the clutch engagement property at low temperature (−30° C.) and have poor low-temperature performance.

INDUSTRIAL APPLICABILITY

The grease according to the present invention is excellent in low-temperature performance and has low oil separation tendency and, therefore, may be used in various applications. In particular, when used in a rotation transmission device having a built-in one-way clutch, the grease can provide satisfactory clutch engagement performance (intermeshing) at low temperatures and is less apt to cause oil separation under high centrifugal force. Therefore, the grease may be suitably used in various rotation transmission devices having a built-in one-way clutch.

The invention claimed is:

1. A grease comprising:

a base oil comprising at least 50% by mass of a diester compound of neopentyl glycol with 3,5,5-trimethylhexanoic acid or isodecanoic acid, and, as a thickener, a diurea compound represented by formula (2):

$$R^6—NHCONH—R^5—NHCONH—R^7 \quad (2)$$

wherein $R^6$ and $R^7$ each independently represent (X) a $C_6$ to $C_{24}$ monovalent chain hydrocarbon group, (Y) a $C_6$ to $C_{12}$ monovalent alicyclic hydrocarbon group or (Z) a $C_6$ to $C_{12}$ monovalent aromatic hydrocarbon group, and $R^5$ represents a $C_6$ to $C_{15}$ divalent aromatic hydrocarbon group and wherein the x, y and z content (mole %) of the groups X, Y and Z, respectively, in the groups $R^6$ and $R^7$ satisfy the following formulas (a) and (b):

$$(x+y)/(x+y+z) \geq 0.98 \quad (a)$$

$$x/y = 25/75 \text{ to } 15/85 \quad (b).$$

2. The grease as defined in claim 1, further comprising a viscosity increasing agent.

3. The grease as defined in claim 1, further comprising at least one additive selected from a lubricity improver, an antioxidant and a rust preventing agent.

4. The grease as defined in claim 1, wherein the base oil comprises at least 80% by mass of the diester compound.

5. The grease as defined in claim 1, comprising 10 to 30% by mass of said diurea compound, based on the grease.

6. A rotation transmission device having a built-in one-way clutch, comprising the grease as defined in claim 1.

7. The grease as defined in claim 1, comprising at least 50% by mass of a diester compound of neopentyl glycol with 3,5,5-trimethylhexanoic acid.

8. The grease as defined in claim 1, comprising at least 50% by mass of a diester compound of neopentyl glycol with isodecanoic acid.

9. The grease as defined in claim 1, wherein the oil component of the grease has a kinematic viscosity at 40° C. of 15 to 150 $mm^2/s$, said oil component being a component remaining after removing the diurea compound from the grease.

* * * * *